US006625408B1

(12) United States Patent
Buch et al.

(10) Patent No.: US 6,625,408 B1
(45) Date of Patent: Sep. 23, 2003

(54) PIN MOUNT FOR OPTICAL WRITER/ IMAGE-RECORDING ELEMENT IN A DOCUMENT PRINTER/COPIER

(75) Inventors: Donald C. Buch, Penfield, NY (US); Robert A. Bovenzi, Rochester, NY (US); Allison A. Cooper, Webster, NY (US); Robert M. Peffer, Rochester, NY (US); Paul H. Tam, Rochester, NY (US); Jeffrey R. Ulreich, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/574,054

(22) Filed: May 18, 2000

(51) Int. Cl.[7] ..... G03G 15/00
(52) U.S. Cl. ..... 399/117; 399/118
(58) Field of Search ..... 399/117–118, 227, 399/167, 177

(56) References Cited

U.S. PATENT DOCUMENTS 5,528,342 A * 6/1996 Setoriyama ..... 399/107
5,615,002 A * 3/1997 Haneda et al. ..... 399/227

* cited by examiner

*Primary Examiner*—Quana M. Grainger

(57) ABSTRACT

A photoconductive drum assembly and an optical writer used in an electrophotographic printer/copier share the same mechanical fiducials for positioning these subsystems within the printer/copier frame or housing. Preferably, a pair of mounting pins used to position and support the drum assembly in a printer frame is also used to position the optical writer. As a result of this mounting scheme, a tolerance stacking problem is reduced and each subsystem can be removed from the printer housing without disturbing the position of the other. Further, the need for a mechanism to retract the optical writer from the vicinity of the drum surface to facilitate drum removal is eliminated, thereby lowering cost and increasing reliability.

9 Claims, 6 Drawing Sheets

PIN MOUNT FOR OPTICAL WRITER/ IMAGE-RECORDING ELEMENT IN A DOCUMENT PRINTER/COPIER

CROSS-REFERENCE TO RELATED APPLICATIONS

Reference is made to the commonly assigned U.S. patent applications, the disclosures of which are incorporated herein by reference.

(1) Ser. No. 09/474,352, filed on Dec. 29, 1999 and entitled "Apparatus for Positioning Work Stations in a Document Printer/Copier."

(2) Ser. No. 09/574,057, filed concurrently herewith and entitled "Skew Adjustment For Optical Writer in a Document printer/Copier."

FIELD OF THE INVENTION

This invention relates to the field of document printing/copying. More particularly, it relates to improvements in apparatus for precisely and repeatedly positioning an electro-optical printhead or "optical writer," e.g. a linear array of light-emitting diodes, relative to a reusable image-recording drum in a document printer/copier, that is, an electrophotographic printer and/or copier, to enable, for example, removal, servicing and replacement of the optical writer and/or image-recording drum without altering a desired positional relationship between the optical writer and image-recording drum inside the document printer/copier.

BACKGROUND OF THE INVENTION

The above-referenced U.S. patent application Ser. No. 09/474,352 discloses an electrophotographic document printer/copier in which the photosensitive recording element comprises a photoconductive drum assembly having structure for precisely positioning the various image-processing stations relative to the drum's photoconductive surface. The drum assembly generally comprises a photoconductive drum having axles extending from opposite ends thereof along an intended axis of drum rotation, and a pair of drum-support members, sometimes referred to as "spiders," that support the drum for rotation. Each of the drum-support members has a centrally located bearing for rotatably supporting a drum axle, and a plurality of mechanical fiducials (in the form of rounded buttons or "bullets") extending in an outward direction relative to the drum's axis of rotation. Each of these fiducials is adapted to engage and mate with a V-notched block or the like associated with one of the image-processing stations (e.g., the primary charger station or toning station) as these stations are moved from a standby position substantially spaced from the drum surface towards an operative position closely spaced from or actually touching the drum surface. When the respective fiducials of the drum assembly have engaged and become seated in the V-blocks of the processing stations, the operative elements of the processing stations (e.g., the corona wire(s) of the primary charging station, or the development brush of the toning station) will have become precisely spaced parallel to, and/or exert substantially uniform pressure on, the drum surface over the entire width of the drum.

In use, the above-described drum assembly is mounted between a pair of parallel and vertically extending "mech" plates comprising the front and rear walls of the printer frame. An opening in the front plate (as viewed from the front of the printer) enables the drum assembly, as well as most of the image-processing stations, to enter the region between the plates. A pair of parallel guide channels, extending between the front and rear walls of the printer frame, engage a pair of ears on the drum-support members and serves to guide the drum assembly to its operative position from a position outside the printer frame. Four dowel pins, two on each frame plate, engage holes in the drum-support members and serve to precisely locate the drum assembly in the printer frame.

Of the different image-processing stations in an electrophotographic printer or copier, the image exposure station is one that requires exceptionally precise positioning relative to the surface of the recording drum. Unless this station is precisely located relative to the nominal position required to produce optimum focus on the photoconductive surface of the drum, the ultimate image on the image-receiver sheet will be noticeably degraded. Ideally, its position within the printer frame should be precisely set by the manufacturer and left undisturbed during the lifetime of the printer. In one respect, this goal is realizable in that the expected lifetime of conventional solid-state printheads is relatively long, far exceeding that of the photoconductive drum assembly and the other image processing stations. However, in printers of the type described above, the printhead must be movably mounted for movement toward and away from the imaging drum to enable the drum assembly to be serviced or replaced. Each time the printhead is moved away from its optimal focus position, there is a chance that it will not be returned to its optimal position. Further, in many systems for positioning the image-processing stations relative to the photoconductive drum surface in a document printer/copier, the exact position of each station will depend on the results of "stacked" tolerances. For example, the final position of the printhead may depend on the respective positions of a series of mechanical fiducials, each having nominal position, within a certain tolerance range, that depends on the placement of other fiducials. Since these tolerances are additive, i.e., stacked atop each other, it is desirable to minimize the number of related fiducials required to position an image-processing station.

SUMMARY OF THE INVENTION

In view of the foregoing discussion, an object of this invention is to reduce the afore-noted tolerance stacking problem associated with prior art printers insofar as it relates to the positioning of an optical writer relative to the surface of a photosensitive recording element.

Another object of this invention is to obviate any need for retracting the optical writer from its operative position in a printer of the type described in order to remove the drum assembly.

According to the present invention, the photosensitive drum assembly and the optical writer used in an electrophotographic printer/copier of the type described share the same mechanical fiducials for positioning these elements within the printer/copier frame or housing. More specifically, two of the mounting pins used to position and support the drum-support members (spiders) of the drum assembly in the printer frame are also used to position the optical writer. Preferably, the point at which each drum-support member contacts the mounting pins is closely spaced, axially speaking, from the point at which the optical writer contacts the mounting pins.

As a result of this mounting scheme, the afore-mentioned tolerance stacking is reduced since the position of the optical writer is not determined by a fiducial carried by the drum-support members, but rather by the very same fiducial that serves to locate the drum-support member in the printer frame. Also, since the optical writer does not contact the drum-support members, there is no need to retract the writer from the drum-support members in order to free-up the drum assembly for removal from the printer. This results in a saving of parts, since here is no need to provide a retractable mount for the writer, and minimizes the need to flex electronic cables and cooling is lines connected to the optical writer, thereby improving reliability Another advantage of this mounting scheme is that, since the optical writer is mounted within the printer frame in a manner that is totally independent of the drum assembly, the optical writer can be removed from the printer without any mechanism for initially retracting the writer from contact with any portion of the drum assembly.

Thus, according to the present invention, an electrophotographic printer/copier comprises: (a) a frame; (b) a drum assembly comprising (i) a drum having a photoconductive surface upon which a plurality of work stations operate to produce an image; and (ii) a pair of drum-support members for rotatably supporting said drum for rotation about a drum axis; (c) an optical writer for projecting image information onto said photosensitive surface; and (d) a mechanical fiducial mounted on said frame, said drum assembly and said optical writer sharing said mechanical fiducial for positioning said drum assembly and said optical writer in said frame to achieve a desired positional relationship between the optical writer and the photoconductive surface of said drum. Preferably, the frame comprises a pair of spaced frame plates, and the mechanical fiducial comprises a pair of dowel pins, one of such pins extending outwardly from each of the frame plates at locations to be engaged by opposite ends of the drum assembly and optical writer.

The invention and its technical advantageous effects will be better appreciated from the ensuing detailed description of a preferred embodiment, reference being made to the accompanying drawings in which like reference characters denote like or functionally similar parts.

DETAILED DESCRIPTION OF THE INVENTION

Figure 1:
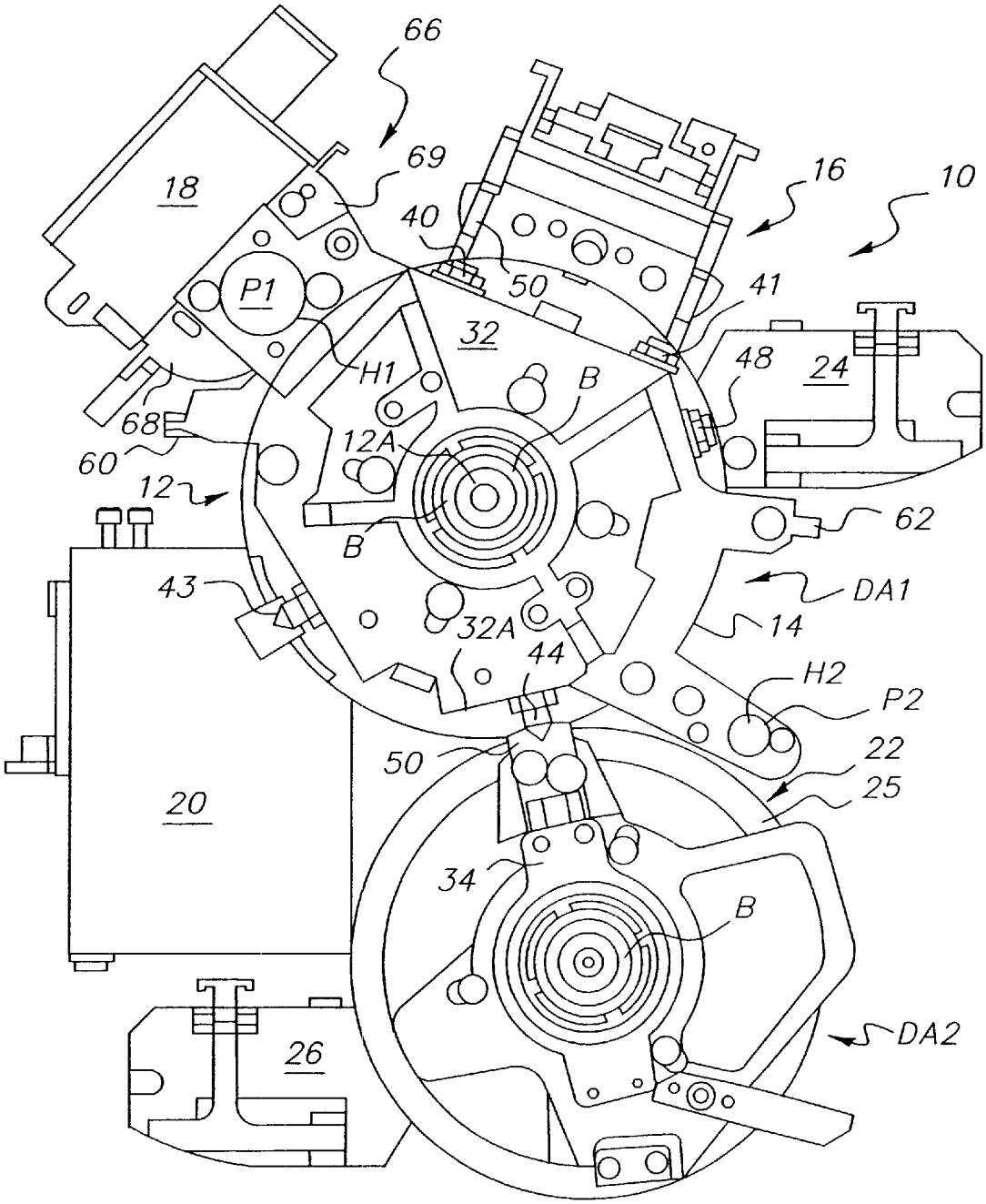
FIG. 1 is end elevation of an electrophotographic printer embodying the present invention.

Referring now to the drawings, FIG. 1 shows an electrophotographic printer 10 embodying the present invention. As shown, printer 10 comprises a drum assembly DA1 that includes an image-recording drum 12 having a photoconductive outer surface 14 on which toner images are formed in a conventional manner. The printer also comprises a second drum assembly DA2 having an intermediate image-transfer drum 22 with an adhesive (non-stick) surface 25 to which toner images formed on the photoconductive outer surface of image-recording drum 12 are transferred prior to being re-transferred to a receiver sheet (not shown). Briefly, toner images are formed on the photoconductive surface of drum 12 by rotating the drum in a counter-clockwise direction (as viewed in FIG. 1) past a series of image processing stations that sequentially operate on a desired portion of the drum's photoconductive outer surface to produce a visible image. These image processing stations include a corona charging station 16 for uniformly charging the photoconductive surface 14 with electrostatic charges, a solid-state print head or optical writer 18 for imagewise exposing the charged photoconductive surface, line-by-line, to actinic radiation, thereby selectively dissipating the uniform charge and leaving behind a latent electrostatic charge image, and a toning station 20 for developing the charge image with pigmented electroscopic toner particles. The toner image thus formed is then transferred to the outer surface 25 of the image-transfer drum 22, and residual toner on drum 12 is removed by a cleaning station 24. Upon re-transferring the toner image on the intermediate transfer drum 22 to an image-receiver sheet, the surface of drum 22 is cleaned by a second cleaning station 26. Preferably, each processing station, with the exception of the optical writer, as explained below, is mounted for slight movement (e.g. about 5 to 7 mm.) towards and away from its respective operative position adjacent the drum surface (shown in FIG. 1) to provide minimal clearance for installation and replacement of the drum assemblies and/or the processing stations. During such installation, the drum assemblies/processing stations are moved substantially parallel to drum's respective axis of rotation, through openings in the front mechanism plate FP of the machine frame F (shown best in FIG. 2).

Figure 3A:
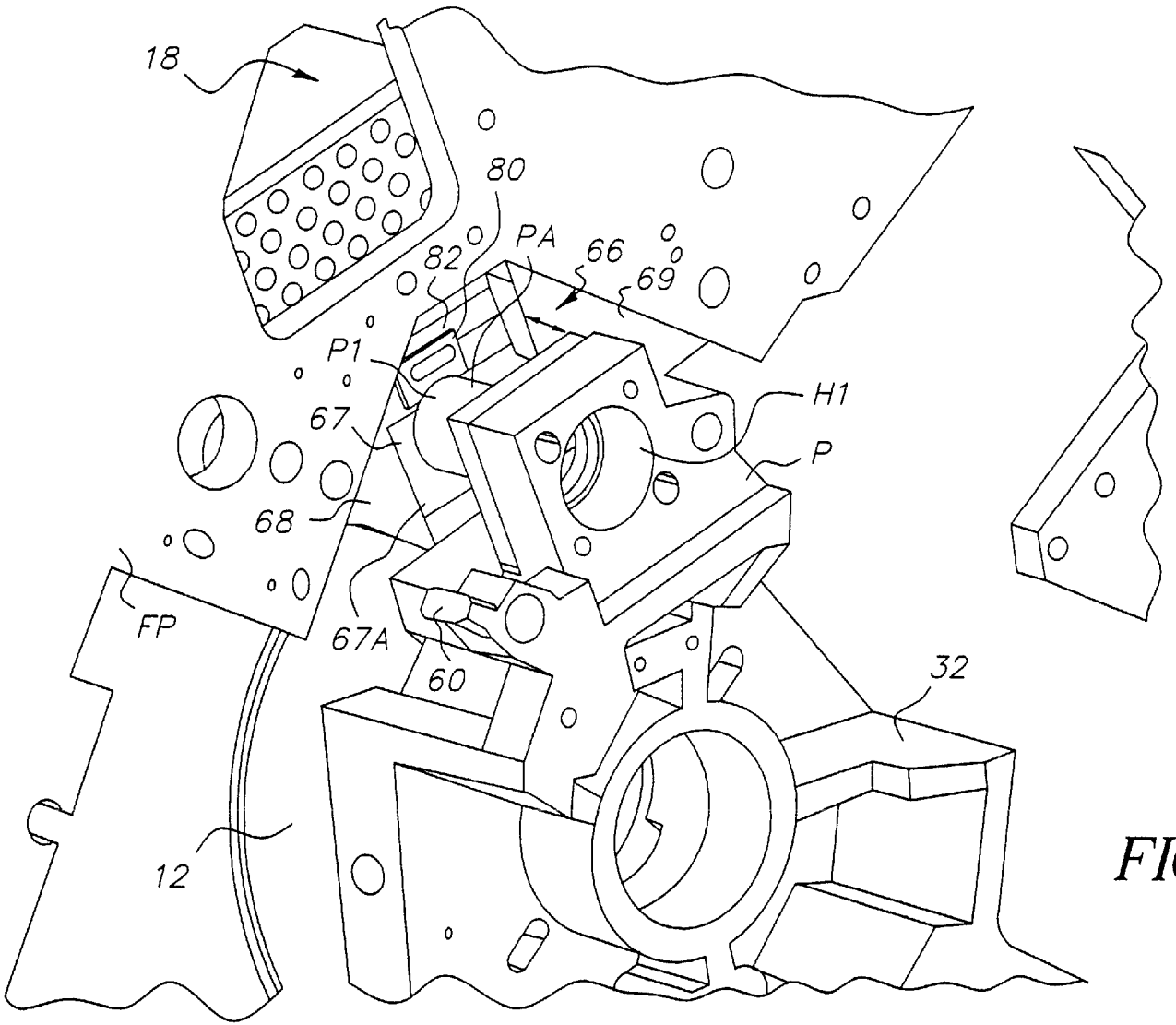
FIGS. 3A and 3B are enlarged perspective views of different portions of the electrophotographic printer shown in FIG. 1.
Figure 3B:
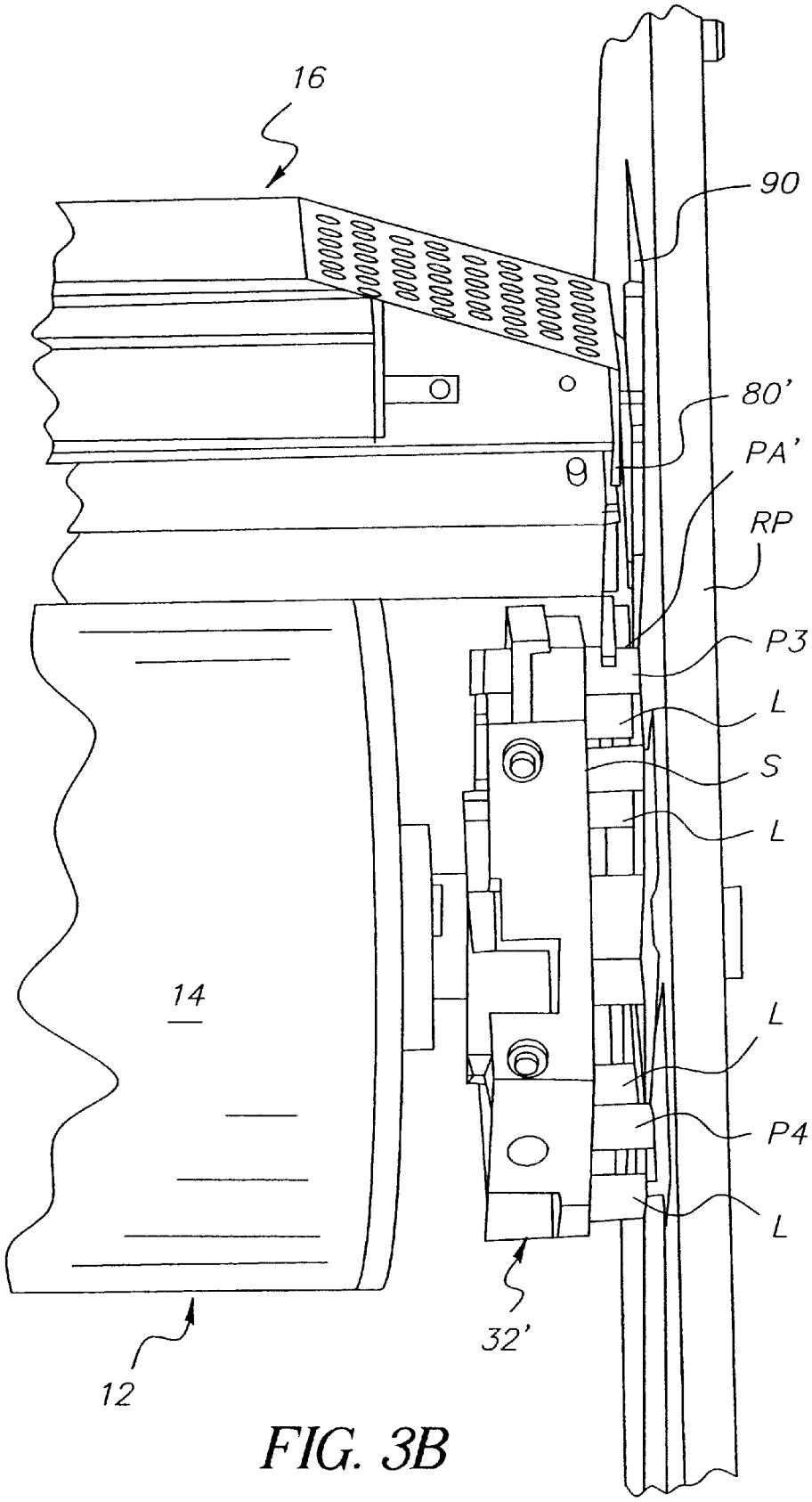
Figure 4:
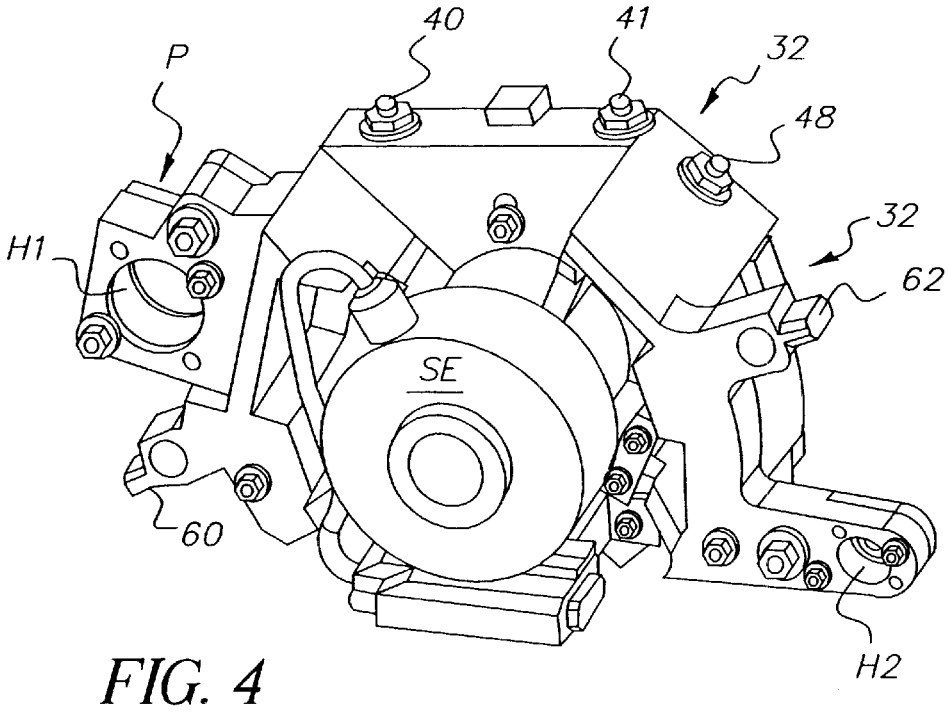
FIGS. 4 and 5 are perspective views of drum-support members.
Figure 5:
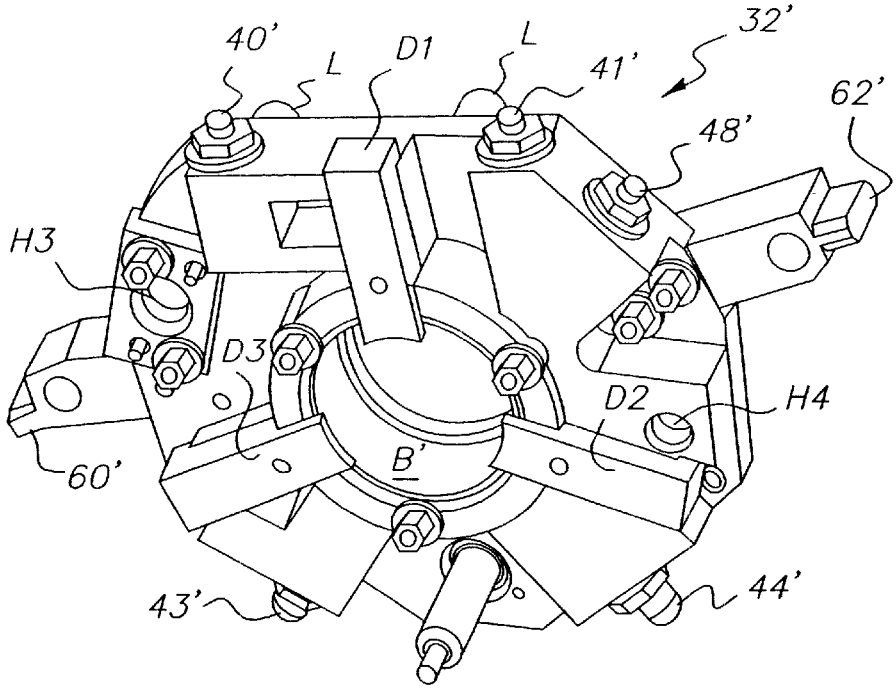

Referring additionally to FIGS. 3A, 3B, 4 and 5, the photoconductive drum assembly DA-1 comprises, in addition to photoconductive drum 12, a pair of a pair of drum-support members 32,32'. These drum-support members are better described in the aforementioned U.S. patent application Ser. No. 09/474,352, the disclosure of which is hereby incorporated herein by reference. Briefly, members 32,32' serve to precisely and repeatedly positioning the various image processing and other work stations of the printer relative to the outer surfaces of the image-recording drum 12 to enable, for example, removal, servicing and replacement of the individual work stations and/or drum without altering a desired positional relationship between the work stations and the drum. Each drum-support member 32,32' has a centrally located bearing B or the like for rotatably supporting a drum axle (e.g., drum axle 12A shown in FIG. 1 extending outwardly from an end of drum 12). The drum-support members, in turn, are supported in a predetermined position within the printer frame F, on a plurality of dowel pins P1–P4 mounted on the front and rear mechanism plates FP,RP, respectively, of the printer frame F. Drum-support members 32,32' are provided with a plurality of reference surface features 40, 41, 43, 44, 48; and 40', 41', 43', 44' 48', respectively, which cooperate with complimentary reference surface features (e.g. v-notched blocks) carried by the respective processing stations to precisely position the work stations relative to the outer surface of the drum. Thus, as the work stations are moved from their respective stand-by or loading positions toward their operative positions, shown in FIG. 1, the reference surface features of the work stations move into contact with and engage the reference surface features on the drum-support members to locate each work station in a desired position relative to the drum surface FIGS. 4 and 5 are enlarged front views of the front and rear drum-support members 32 and 32', respectively. Front member 32 supports a shaft encoder SE through which the rotational speed of drum 12 is monitored for the purpose of controlling the operation of the optical writer. A plurality of clamps D1–D3 on each drum-support member serves to retain the bearing B used to rotatably support one of the drum axles. Ears 60, 62 carried by the front member 32, and ears 60', 62' carried by rear member 32' cooperate with a pair of guide channels (not shown) positioned between the frame plates for the purpose of slidably guiding the drum assembly to its operating position where it is supported by a plurality of dowel pins P1–P4 on the front and rear walls of the printer frame. Pins P1–P4 are adapted to engage holes H1–H4, respectively, formed in the front and rear drum-support members to precisely position the drum assembly within the printer frame.

Figure 6:
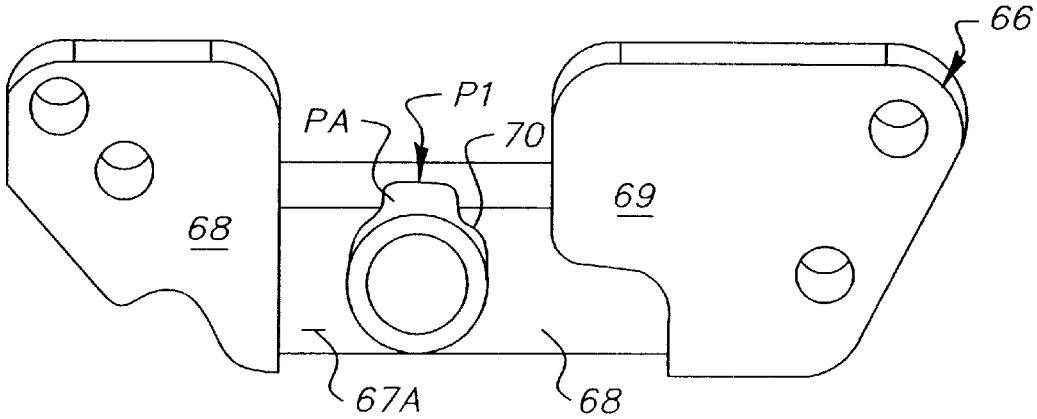
FIG. 6 is an enlarged front perspective view of a frame piece supporting a dowel pin.
Figure 7:
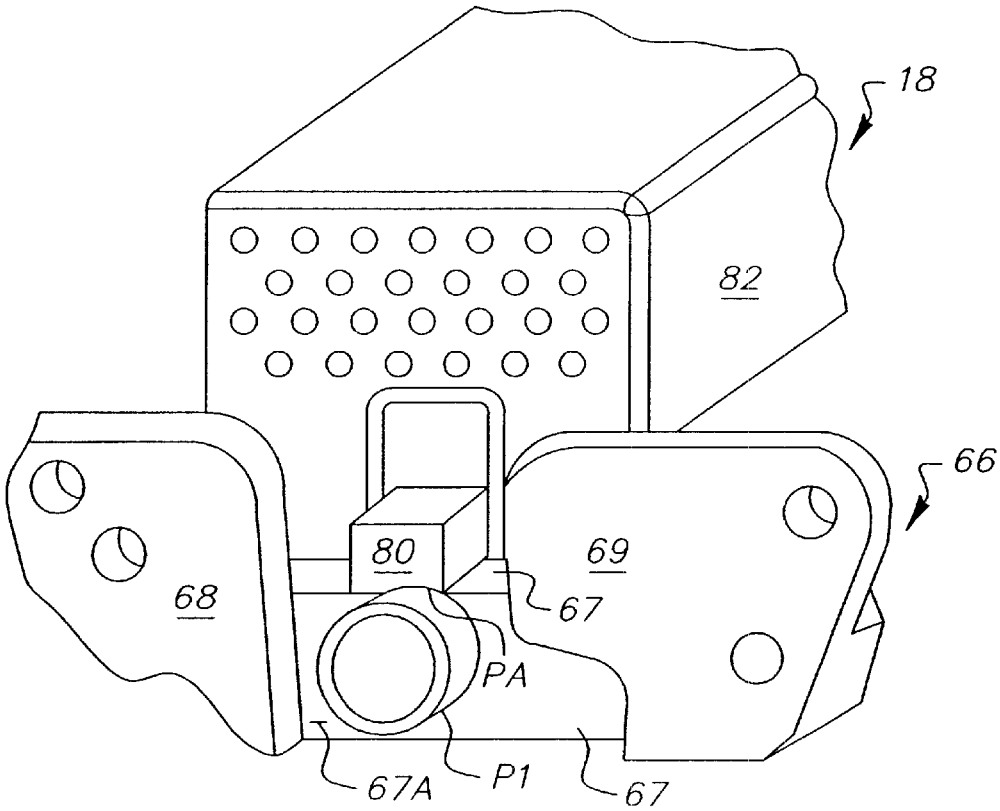
FIG. 7 is a front perspective view of a portion of an optical writer supported by the dowel pin shown in FIG. 6.

In accordance with the present invention, dowel pins P1 and P3, in addition to functioning to position the drum assembly within the printer frame, also function to position the optical writer relative to the photoconductive surface of drum 12. Referring to FIG. 6, dowel pin P1 is shown to be supported by a frame piece 66 that is adapted to be bolted to the rear surface of the front frame plate FP so as to become part of the front frame plate. Preferable, pin P1 is made of hardened steel and has a diameter of about 20 mm. Frame piece 66 also made of hardened steel and comprises a flat bar portion 67 extending between a pair of tabs 68 and 69. The indented space between tabs 68 and 69 is shaped to receive that portion P of drum-support member 32 in which hole H1 is formed. See FIG. 4. Thus, as the drum assembly slides inwardly into the printer frame and hole H1 eventually engages and slides upon pin P1, its inward movement will be arrested as the rear surface of portion P engages the front surface 67A of bar portion 67 of the frame piece 66. Bar portion 67 has a hole 70 formed therein, and dowel pin P1 is press fit therein. When fully seated on pin P1, that portion of pin P1 in the vicinity of the surface 67A acts as a fiducial or reference point for locating the drum assembly 12. Preferably, hole 70 does not pass entirely through the bar portion 67, and the top portion of the bar portion is milled away so that an outer surface area PA of dowel pin PI received in hole 70 will be exposed. As shown in FIG. 7, it is this portion PA of pin P1 that is used to support and act as a fiducial for the optical writer. Preferably, a V-notch block 80 associated with the optical writer frame 82 is urged into contact with surface area PA at a location very closely spaced from the plane in which the pin supports the drum-support member 32 of drum assembly DA-1, i.e., in the vicinity of surface 67A. Ideally, the planes in which pin P1 supports both the optical writer and the drum assembly should coincide. In such case, the same reference point on the fiducial is used to locate the optical writer and drum assembly, and any tipping of the pin in bar 67 will have no effect on the relative positions of these subsystems. However, if the two reference points are within, say, 5 mm. of each other, the effect of any anticipated tipping of pin P1 will be negligible.

Figure 2:
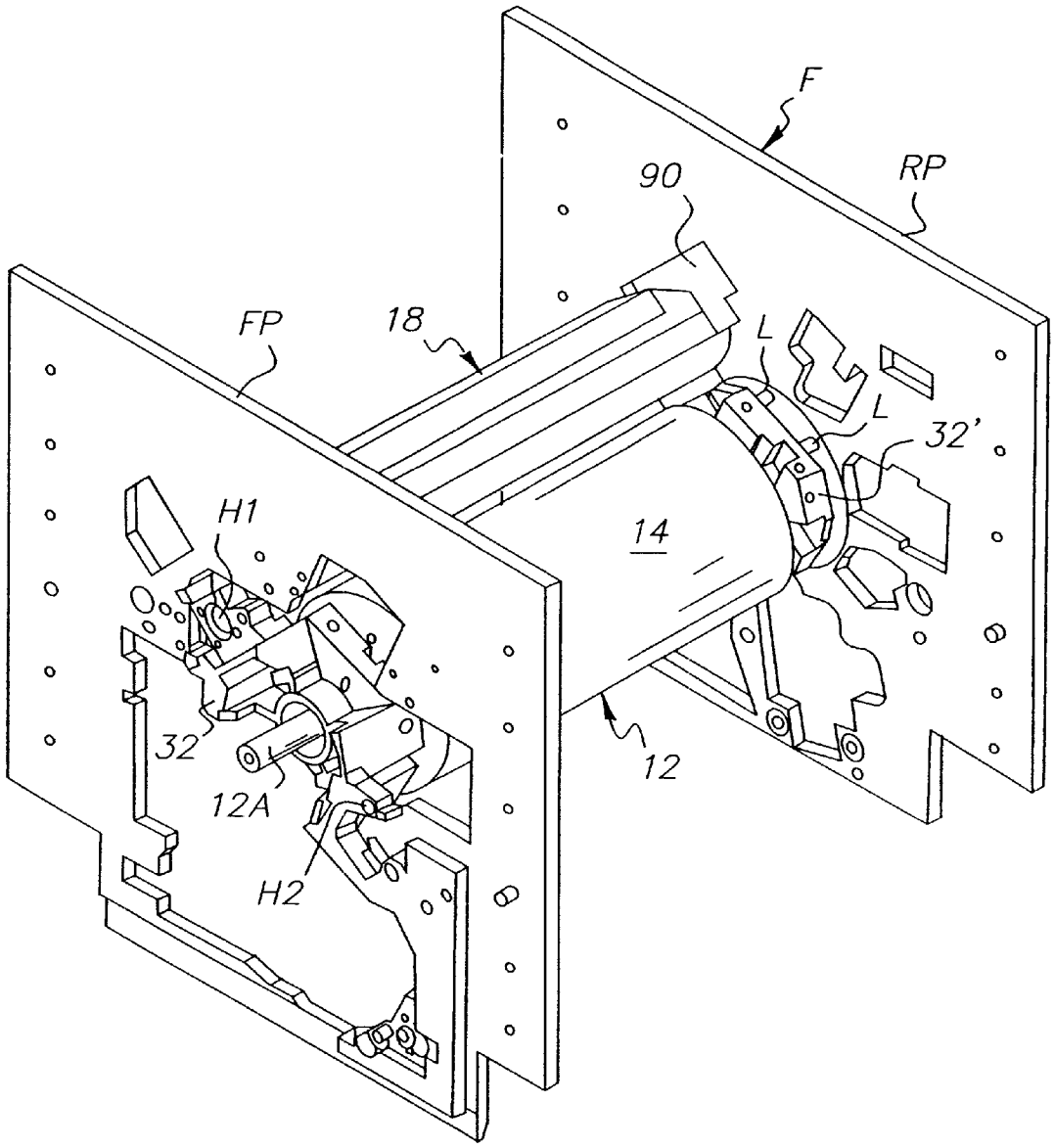
FIG. 2 is a perspective view of a portion of the FIG. 1 apparatus.

Referring to FIGS. 2 and 3B, the rear drum-support member 32' is supported on dowel pins P3 and P4 carried by the rear mech plate RP of the printer frame. Pins P3 and P4 engage holes H3 and H4, respectively, formed in member 32'. When moved to it rearmost position on pin P3, the rear surface S of drum-support member 32' will be slightly spaced (by about 6 mm) from the front surface of the rear mech plate RP by a plurality of legs L. As a result, a space PA' is provided on the upper surface of pin P3 for receiving and supporting a V-block 80' mounted on the opposite end of the optical writer frame that supports V-block 80. Again, owing to the close spacing between the points at which pin P3 supports both the drum-support member 32' and V-block 80', virtually the same portion of the pin operates as the fiducial for both the drum assembly and the optical writer, thereby eliminating the tolerance stacking problem discussed above.

From the foregoing, it will be appreciated that a technically advantageous method and apparatus have been provided for mounting a solid-state optical writer in a document printer/copier. By using the same mechanical fiducial to locate both the photoconductive drum assembly and the optical writer, a stacking of mechanical tolerances is avoided. Further, by using a different portion of the fiducial to register each subsystem, either subsystem can be removed from the printer without disturbing the other. For example, the optical writer can be removed through the back of the printer through opening 90 in the rear mech plate, and the drum assembly can be removed through an opening in the front mech plate.

The invention has been described with reference to an electrophotographic printer/copier apparatus. An example of an electrophotographic printer/copier apparatus is described in U.S. patent application Ser. No. 08/900,696, filed in the name Tombs et al, the contents of which are incorporated herein by reference. The apparatus and method of the invention may be used to locate the writer or other process or work station, such as a charging station, development station, cleaning station which typically operates upon a photoconductive surface during an electrophotographic process. The invention may also be used for positioning a process or work station about other toner image bearing or recording surfaces such as an intermediate transfer member. The invention has been described with reference to positioning a process or work station about a drum. However, the invention also contemplates that the apparatus and method thereof may also be used to accurately position a process station in any electrostatographic apparatus about a toner image bearing or recording surface including surfaces formed as a web wherein the web is supported by a roller. The roller would be journaled for rotation and accurately located relative to the frame by having a first surface connected thereto engaging one portion of the pin and a process station operating on a toner image bearing or recording surface and having a second surface connected to the process station engaging a second portion of the pin to accurately locate the process station relative to the toner image bearing or recording surface. The apparatus and method of the invention may also be used in electrographic recording apparatus wherein stylus writers or other types of writers or other process stations are used to record or transfer electrostatic images on a surface and are required to be accurately positioned relative to the toner image bearing or recording surface.

While the invention has been described with reference to a particularly preferred embodiment, it will be appreciated that variations can be made without departing from the spirit of the invention, and such variations are intended to fall within the scope of the appended claims.

PARTS LIST

10—electrophotographic printer
12—image-recording drum
14—photoconductive surface
16—corona charging station

18—print head
20—development station
22—image-transfer drum
24—cleaning station
26—cleaning station
32,32'—drum support members for drum 12
34—drum support members for drum 22
36—frame piece
37—bar portion of frame piece 40, 40', 41, 41', 43, 43', 44, 44', 48, 48'—fiducials on drum support members for positioning printer work stations
50—V-grooved block
60,62—ears for guiding drum assembly
66—frame piece
67, 68, 69—portions of frame piece
67A—front surface of member 67
80,80'—V-block fiducials for positioning optical writer
82—optical writer frame
90—opening in rear mech plate
DA1—drum assembly 1
DA2—drum assembly 2
A—drum axles
B—bearings
F—printer frame
L—legs on rear drum-support member 32'
P—portion of front drum-support member 32
FP—front plate of printer frame
RP—rear plate of printer frame
SE—shaft encoder
D1–D3—bearing-retainers
P1–P4—mounting pins
H1–H4—mounting holes
PA,PA'—fiducials for positioning optical writer

What is claimed is:

1. In an electrophotographic printer/copier comprising:

(a) a frame;

(b) a drum assembly comprising (i) a drum having a photoconductive outer layer upon which a plurality of work stations are intended to operate to produce an image; and (ii) a pair of drum-support members for rotatably supporting said drum for rotation about a drum axis, each of said drum-support members having a centrally located bearing adapted to receive and rotatably support one end of said drum;

(c) an optical writer for projecting image information onto said photosensitive surface; and (d) a mechanical fiducial having a first portion attached to said drum assembly and a second portion attached said optical writer in said frame for placement of said drum and said optical writer on said frame in a predetermined position.

2. The apparatus as defined by claim 1 wherein said frame comprises a pair of spaced frame plates, and wherein said mechanical fiducial comprises a pair of mounting pins, one of said pins extending outwardly from each of said frame plates.

3. The apparatus as defined by claim 2 wherein said mounting pins engage holes in said drum-support members whereby said drum assembly is supported by said pins at first locations along the respective outer surfaces of said pins, and wherein said optical writer comprises a frame having portions that contact said respective outer surfaces at second locations closely spaced from said first location.

4. The apparatus as defined by claim 2 wherein an exposed portion of the outer surface of at least one of said pins is located proximate the plane in which a drum-support member is supported by of one of said frame plates.

5. A method for positioning an optical writer relative to a photosensitive surface of an image-recording drum on a frame comprising an electrophotographic printer/copier, said method comprising the steps of:

(a) providing a mechanical fiducial on said frame;

(b) engaging a first portion of said mechanical fiducial with structure for positioning said image-recording drum on said frame; and (c) engaging a second portion of said mechanical fiducial with structure for positioning said optical writer on said frame.

6. An electrostatographic printer/copier comprising:

(a) a frame, the frame supporting a locating fiducial element;

(b) an assembly comprising (i) a rotating member carrying a surface for supporting a toner image on which surface one or more process stations operate, (ii) a pair of support members for supporting said rotating member for rotation about an axis, and (iii) a first structure for engaging the locating fiducial element to locate the assembly on the frame; and (c) an optical writing station for operating upon said surface, said optical writing station engaging the locating fiducial element to locate the optical writing station relative to the surface.

7. The apparatus as defined by claim 6 wherein said fiducial element comprises a mounting pin and one part of the surface of the pin engages the first structure and a second part of the surface of the pin engages the second structure.

8. A method for positioning a process station relative to an image supporting surface of a recording apparatus, said method comprising:

(a) providing a fiducial element on a frame of the recording apparatus;

(b) engaging a first portion of said fiducial element with a structure for positioning a rotational member that supports the image supporting surface to locate the image supporting surface relative to the frame;

(c) engaging a second portion of said fiducial element with a structure for positioning a process station that operates upon said image supporting surface to accurately locate said process station relative to said image supporting surface.

9. The method as defined by claim 8 wherein the fiducial element comprises a pin and one part of a surface of the pin engages the first structure and a second part of the surface of the pin engages the second structure.

* * * * *